US009342937B2

(12) United States Patent
Yoshizawa

(10) Patent No.: US 9,342,937 B2
(45) Date of Patent: May 17, 2016

(54) CONTROL SYSTEM DURING FUEL SUPPLY TO VEHICLE, AND PORTABLE DEVICE

(71) Applicant: Daisuke Yoshizawa, Aichi (JP)

(72) Inventor: Daisuke Yoshizawa, Aichi (JP)

(73) Assignee: OMRON AUTOMOTIVE ELECTRONICS CO., LTD., Aichi (JP)

( * ) Notice: Subject to any disclaimer, the term of this patent is extended or adjusted under 35 U.S.C. 154(b) by 317 days.

(21) Appl. No.: 13/973,106

(22) Filed: Aug. 22, 2013

(65) Prior Publication Data

US 2014/0055232 A1 Feb. 27, 2014

(30) Foreign Application Priority Data

Aug. 22, 2012 (JP) ..... 2012-182885

(51) Int. Cl.
*G07C 9/00* (2006.01)

(52) U.S. Cl.
CPC ..... *G07C 9/00309* (2013.01); *G07C 9/00896* (2013.01)

(58) Field of Classification Search
CPC ..... G07C 9/00309; G07C 9/00896
USPC ..... 340/5.7; 701/49
See application file for complete search history.

(56) References Cited

U.S. PATENT DOCUMENTS

2006/0012479 A1 1/2006 Ezra
2009/0043450 A1* 2/2009 Tonegawa ..... B60L 11/1814 701/36
2009/0177580 A1 7/2009 Lowenthal et al.
2010/0121551 A1* 5/2010 Boss ..... B60K 15/00 701/99
2010/0211272 A1* 8/2010 Ichihara ..... B67D 7/145 701/49
2013/0006776 A1* 1/2013 Miller ..... G06Q 20/3276 705/14.65

FOREIGN PATENT DOCUMENTS

EP 1995109 A1 11/2008
JP 2005075308 A 3/2005
JP 2007-252016 A 9/2007
JP 2008120193 A 5/2008

(Continued)

OTHER PUBLICATIONS

Translation of JP 2010-127030 A, Kazuhiro, published Oct. 6, 2010.*

(Continued)

*Primary Examiner* — Edwin Holloway, III
(74) *Attorney, Agent, or Firm* — Osha Liang LLP

(57) ABSTRACT

A control system during fuel supply to a vehicle has a portable device configured to be carried by a user, and an in-vehicle device that is mounted on the vehicle to conduct wireless communication with the portable device. The portable device is configured to conduct wireless communication with a facility communicator that is installed in a fuel supply facility. The in-vehicle device includes a portable device authentication part that authenticates the portable device and a fuel supply lid controller that opens or unlocks a fuel supply lid of the vehicle. The portable device receives a fuel supply inquiry signal transmitted by the facility communicator when the facility communicator detects an operation performed by the user or existence of the user. The portable device transmits a fuel supply starting message signal and authentication information on the portable device to the in-vehicle device when receiving the inquiry signal from the facility communicator.

17 Claims, 7 Drawing Sheets

(56) References Cited

FOREIGN PATENT DOCUMENTS

| | | | |
|---|---|---|---|
| JP | 2010-127030 | A | 6/2010 |
| JP | 2010186258 | A | 8/2010 |
| JP | 2011175399 | A | 9/2011 |
| WO | 2009-047988 | A1 | 4/2009 |

OTHER PUBLICATIONS

Japanese Office Action for Application No. 2012-182885, mailed on Jul. 8, 2014 (9 pages).
Office Action issued in corresponding German Application No. 10 2013 216 580.3, mailed on Jul. 28, 2015 (12 pages).

* cited by examiner

CONTROL SYSTEM DURING FUEL SUPPLY TO VEHICLE, AND PORTABLE DEVICE

BACKGROUND

1. Technical Field

The present invention relates to a technology of wireless communication among devices provided in a fuel supply facility and a vehicle when fuel is supplied to the vehicle.

2. Related Art

Japanese Unexamined Patent Publication Nos. 2008-120193 and 2005-75308 each disclose a technology of providing security to opening and closing of a fuel supply lid of a vehicle. In the technology, an in-vehicle device mounted on the vehicle conducts wireless communication with a portable device carried by a user using an antenna provided near the fuel supply lid, and authenticates the portable device, and the fuel supply lid is opened or unlocked when the authentication is completed.

Japanese Unexamined Patent Publication Nos. 2010-186258 and 2011-175399 each disclose a technology for improving convenience during the fuel supply. In the technology disclosed in Japanese Unexamined Patent Publication No. 2010-186258, in order to eliminate an order information input operation performed by a user, the in-vehicle device automatically transmits order information stored in a memory to a roadside machine installed in a self-service gas station when a mutual authentication is established between the in-vehicle device and the roadside machine. After the fuel supply, the roadside machine calculates a payment amount based on a fuel supply state, and transmits the fuel supply state and the payment amount to the in-vehicle device. The in-vehicle device informs the user of the fuel supply state and the payment amount, which are received from the roadside machine. The order information stored in the memory of the in-vehicle device is rewritten by a mobile phone carried by the user.

In the technology disclosed in Japanese Unexamined Patent Publication No. 2011-175399, power feeding equipment, a power equipment facility management server, a facility management server, and a terminal are installed in a power feeding facility that feeds a power to an electric automobile. The devices can conduct communication with one another in a wired or wireless manner. A power transmission unit of the power feeding equipment performs power feeding process to the vehicle that stops in a parking lot, and acquires identification information on the vehicle or the user from the in-vehicle device mounted on the vehicle. The power transmission unit displays options of an electricity charge payment method on a screen, and notifies the power feeding equipment management server or the facility management server of the payment method selected by the user. The power transmission unit also notifies the power feeding equipment management server or the facility management server of information on charging of the power fed to the vehicle.

After the power feeding is completed, when the identification information on the vehicle or the user and identification information on the power feeding equipment are wirelessly input to the terminal from the mobile phone carried by the user, the terminal receives the payment of the power fed to the vehicle. When the user performs payment processing for the electricity charge using the terminal, the terminal notifies the facility management server or the power feeding equipment management server that the payment is completed.

SUMMARY

One or more embodiments of the present invention improves the convenience during the fuel supply to the vehicle.

In accordance with one or more embodiments of the present invention, a control system during fuel supply to a vehicle, includes: a portable device that is carried by a user; an in-vehicle device that is mounted on the vehicle to conduct wireless communication with the portable device; and a facility communicator that is installed in a fuel supply facility to conduct wireless communication with the portable device, wherein the in-vehicle device includes a portable device authentication part that authenticates the portable device and a fuel supply lid controller that opens or unlocks a fuel supply lid of the vehicle, the facility communicator transmits a fuel supply inquiry signal to the portable device when detecting an operation performed by the user or existence of the user, the portable device transmits a fuel supply starting message signal and authentication information on the portable device to the in-vehicle device when receiving the inquiry signal from the facility communicator, the in-vehicle device authenticates the portable device using the portable device authentication part based on the authentication information when receiving the starting message signal and the authentication information from the portable device, and the in-vehicle device opens or unlocks the fuel supply lid using the fuel supply lid controller when the authentication result is normal.

In accordance with one or more embodiments of the present invention, a portable device that is carried by a user, conducts wireless communication with an in-vehicle device mounted on a vehicle, and is authenticated by the in-vehicle device, wherein the portable device transmits a fuel supply starting message signal and authentication information on the portable device to the in-vehicle device to cause the in-vehicle device to authenticate the portable device when conducting wireless communication with a facility communicator mounted on a fuel supply facility to receive a fuel supply inquiry signal from the facility communicator, and portable device causes the in-vehicle device to open or unlock a fuel supply lid of the vehicle when the authentication result is normal.

According to one or more embodiments of the present invention, the communication among the facility communicator, the portable device, and the in-vehicle device and the opening or unlocking of the fuel supply lid of the vehicle are automatically performed, so that the convenience during the fuel supply to the vehicle can be improved.

In one or more embodiments of the present invention, the in-vehicle device may further include a running source controller that controls driving of a running source of the vehicle, and the running source controller may stop the driving of the running source when the starting message signal is received from the portable device.

In one or more embodiments of the present invention, the control system may further include a mobile terminal that is carried by the user to conduct short-distance wireless communication with the portable device. In this case, the mobile terminal includes a payment part that performs payment processing for fuel supply. The facility communicator transmits amount paid information indicating a price of the fuel supply to the portable device after the fuel supply to the vehicle is completed. The portable device transmits the amount paid information and requirement-of-payment signal to the mobile terminal when receiving the amount paid information from the facility communicator. The mobile terminal performs the payment processing using the payment part based on the amount paid information when receiving the amount paid information and the requirement-of-payment signal from the portable device. The mobile terminal transmits completion-of-payment information to the portable device when the payment part completes the payment processing. The portable device transmits the completion-of-payment information to the facility communicator when receiving the completion-of-payment information from the mobile terminal. The facility communicator notifies the user that payment of the fuel supply is completed when receiving the completion-of-payment information from the portable device.

In one or more embodiments of the present invention, the facility communicator may include a display screen, the facility communicator may display options of a payment method on the display screen when detecting the operation performed by the user or the existence of the user, and the facility communicator may transmit the inquiry signal to the portable device when the user selects the payment by the mobile terminal in the options.

In one or more embodiments of the present invention, the facility communicator may transmit inquiry signal and device information authenticating the facility communicator to the portable device. In this case, the portable device may include a communicator authentication part that authenticates the facility communicator, the portable device may authenticate the facility communicator using the communicator authentication part based on the device information when receiving the device information from the facility communicator, and the portable device may transmit a fuel supply starting request signal to the facility communicator when the authentication result is normal.

In one or more embodiments of the present invention, the portable device may authenticate the facility communicator using the communicator authentication part based on the device information when receiving the amount paid information and the device information from the facility communicator, and the portable device may transmit the amount paid information and the requirement-of-payment signal to the mobile terminal when the authentication result is normal.

In one or more embodiments of the present invention, the portable device may transmit the amount paid information, the requirement-of-payment signal, and authentication information on the portable device to the mobile terminal. In this case, the mobile terminal includes a pre-payment authentication part that authenticates the portable device before the payment processing, the mobile terminal authenticates the portable device using the pre-payment authentication part based on the authentication information when receiving the amount paid information, the requirement-of-payment signal, and the authentication information from the portable device, and the mobile terminal performs the payment processing using the payment part based on the amount paid information when the authentication result is normal.

According to one or more embodiments of the present invention, the convenience during the fuel supply to the vehicle can be improved.

DETAILED DESCRIPTION

Figure 1:
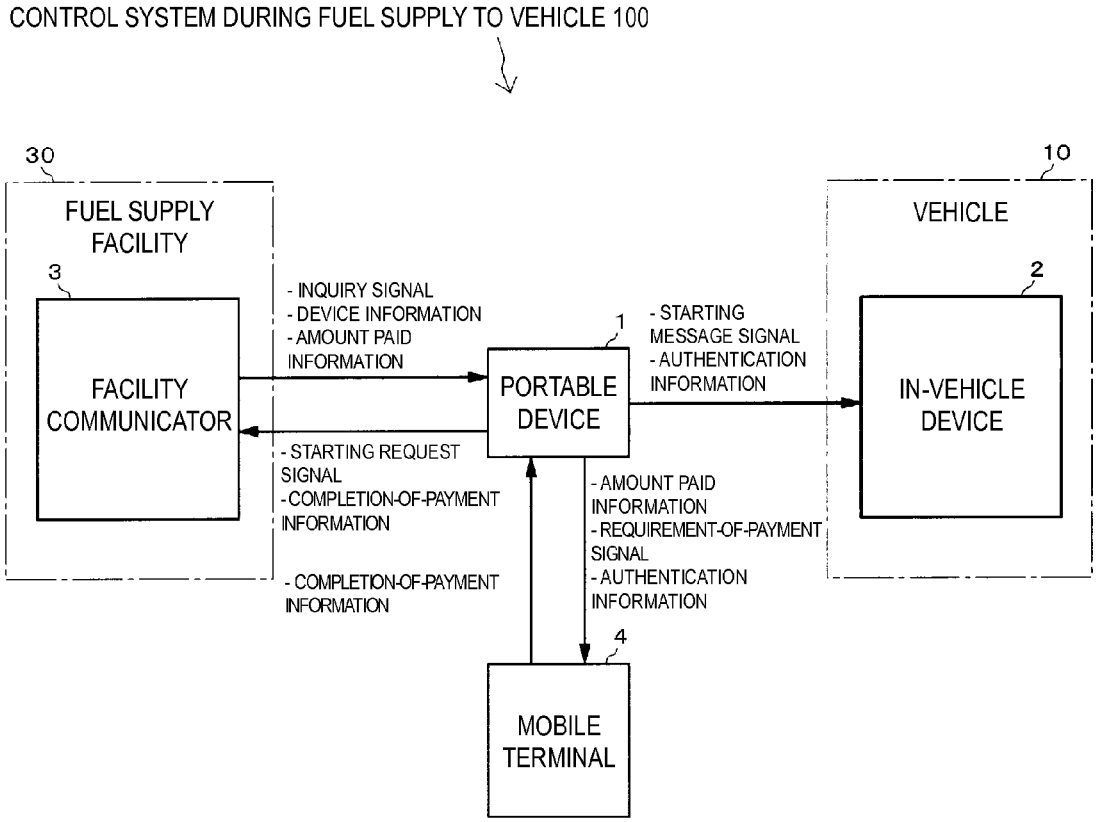
FIG. 1 is a view illustrating a configuration of a control system during fuel supply to a vehicle according to one or more embodiments of the present invention.

Hereinafter, embodiments of the present invention will be described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. In the drawings, the identical or equivalent component is designated by the identical numeral.

A configuration of a control system during fuel supply to a vehicle (hereinafter simply referred to as a "control system") 100 according to one or more embodiments of the present invention will be described with reference to FIGS. 1 to 5.

As illustrated in FIG. 1, the control system 100 includes a portable device 1, an in-vehicle device 2, a facility communicator 3, and a mobile terminal 4. The portable device 1 conducts predetermined wireless communication (communication using an LF (Low Frequency) signal or a UHF (Ultra High Frequency) signal) with the in-vehicle device 2 and the facility communicator 3. The portable device 1 conducts short-distance wireless communication (such as Bluetooth (registered trademark) and NFC communication) with the mobile terminal 4.

Figure 2:
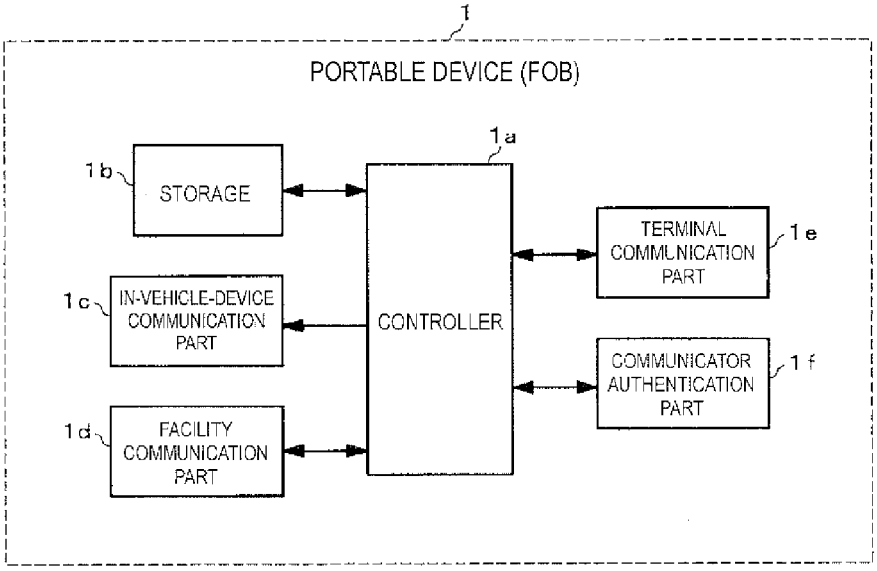
FIG. 2 is a view illustrating a configuration of portable device in FIG. 1.

The portable device 1 includes an FOB key of a passive entry system, and is carried by a user. As illustrated in FIG. 2, the portable device 1 includes a controller 1*a*, a storage 1*b*, an in-vehicle-device communication part 1*c*, a facility communication part 1*d*, a terminal communication part 1*e*, and a communicator authentication part 1*f*.

The controller 1*a* includes a microcomputer, and controls each part of the portable device 1. The storage 1*b* includes a memory, and authentication information on the portable device 1 is stored in the storage 1*b*. Each of the communication parts 1*c*, 1*d*, and 1*e* includes a wireless communication antenna, a transmitting circuit, and a receiving circuit. The in-vehicle-device communication part 1*c* transmits and receives a signal and information to and from the in-vehicle device 2. The facility communication part 1*d* transmits and receives the signal and the information to and from the facility communicator 3. The terminal communication part 1*e* transmits and receives the signal and the information to and from the mobile terminal 4. The communicator authentication part if includes a microcomputer, and authenticates the facility communicator 3. The communicator authentication part if is an example of the "communicator authentication part" according to one or more embodiments of the present invention.

Figure 3:
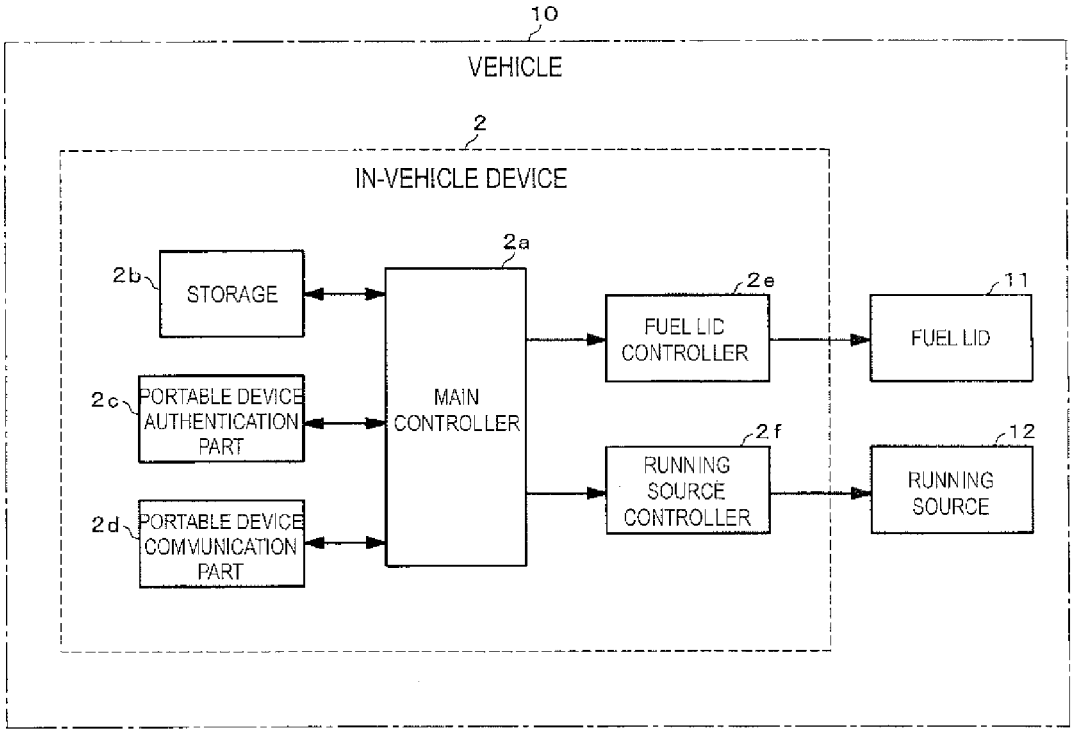
FIG. 3 is a view illustrating a configuration of an in-vehicle device in FIG. 1.

The in-vehicle device 2 in FIG. 1 is mounted on a vehicle 10. As illustrated in FIG. 3, the in-vehicle device 2 includes a main controller 2*a*, a storage 2*b*, a portable device authentication part 2*c*, a portable device communication part 2*d*, a fuel lid controller 2*e*, and a running source controller 2*f*.

The main controller 2*a* includes a microcomputer, and controls each part of the in-vehicle device 2. The storage 2*b* includes a memory, and registered information including identification information on the portable device 1 is stored in the storage 2*b*. That is, the portable device 1 is registered in the in-vehicle device 2. The portable device authentication part 2*c* authenticates the portable device 1. The portable device authentication part 2*c* is an example of the "portable device authentication part" according to one or more embodiments of the present invention. The portable device communication part 2*d* includes the wireless communication antenna, the transmitting circuit, and the receiving circuit. The portable device communication part 2*d* transmits and receives the signal and the information to and from the portable device 1.

The fuel lid controller 2*e* opens or unlocks a fuel lid 11 of the vehicle 10. The fuel lid 11 is an example of the "fuel supply lid" according to one or more embodiments of the present invention. The fuel lid controller 2*e* is an example of the "fuel supply lid controller" according to one or more embodiments of the present invention. The running source controller 2*f* control driving of a running source 12 of the vehicle 10. The running source 12 includes an engine or a drive motor. The running source controller 2*f* is an example of the "running source controller" according to one or more embodiments of the present invention.

Figure 4:
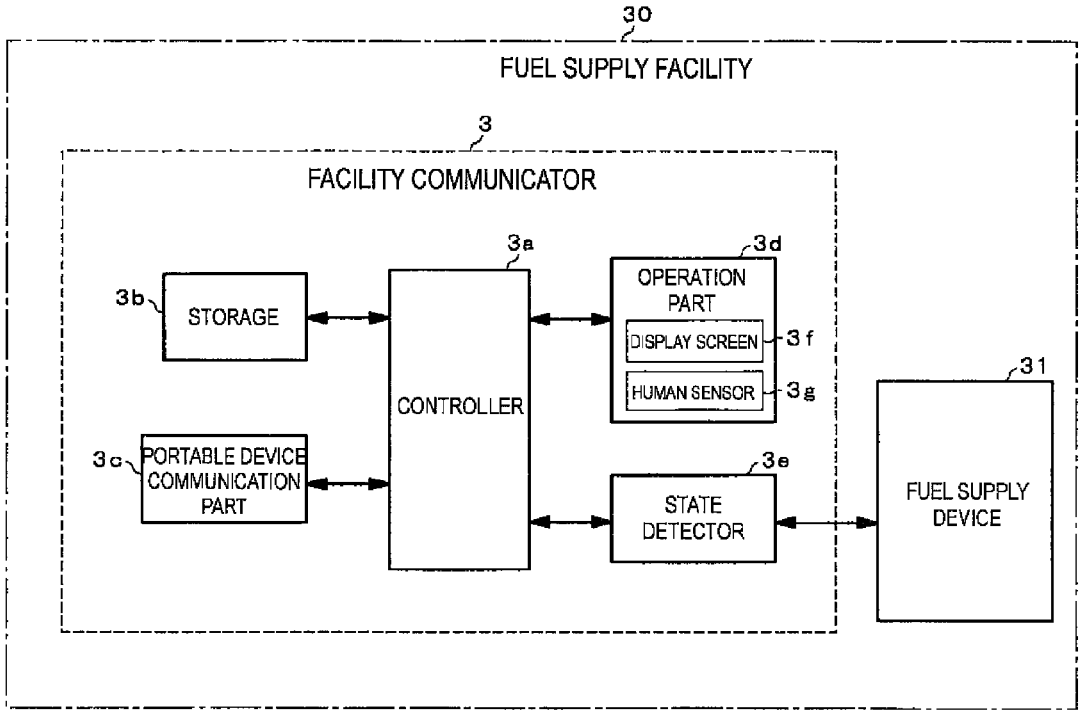
FIG. 4 is a view illustrating a configuration of a facility communicator in FIG. 1.

The facility communicator 3 in FIG. 1 is installed in a fuel supply facility 30 such as a fuel-supply station and a charging station. As illustrated in FIG. 4, a fuel supply device 31 is also installed in the fuel supply facility 30. For example, the fuel supplied to the vehicle 10 with the fuel supply device 31 is gasoline or electricity. The facility communicator 3 includes a controller 3*a*, a storage 3*b*, a portable device communication part 3*c*, an operation part 3*d*, and a state detector 3*e*.

The controller 3*a* includes a microcomputer, and controls each part of the facility communicator 3. The storage 3*b* includes a memory, and device information authenticating the facility communicator 3 is stored in the storage 3*b*. The portable device communication part 3*c* includes a wireless communication antenna, a transmitting circuit, and a receiving circuit. The portable device communication part 3*c* transmits and receives the signal and the information to and from the portable device 1. The operation part 3*d* includes a display screen 3*f*, a human sensor 3*g*, and an operation button (not illustrated). The display screen 3*f* includes a touch panel, and information on the fuel supply is displayed on the display screen 3*f*. The human sensor 3*g* senses that a user stands in front of the facility communicator 3. The state detector 3*e* detects states of the facility communicator 3 and the fuel supply device 31.

Figure 5:
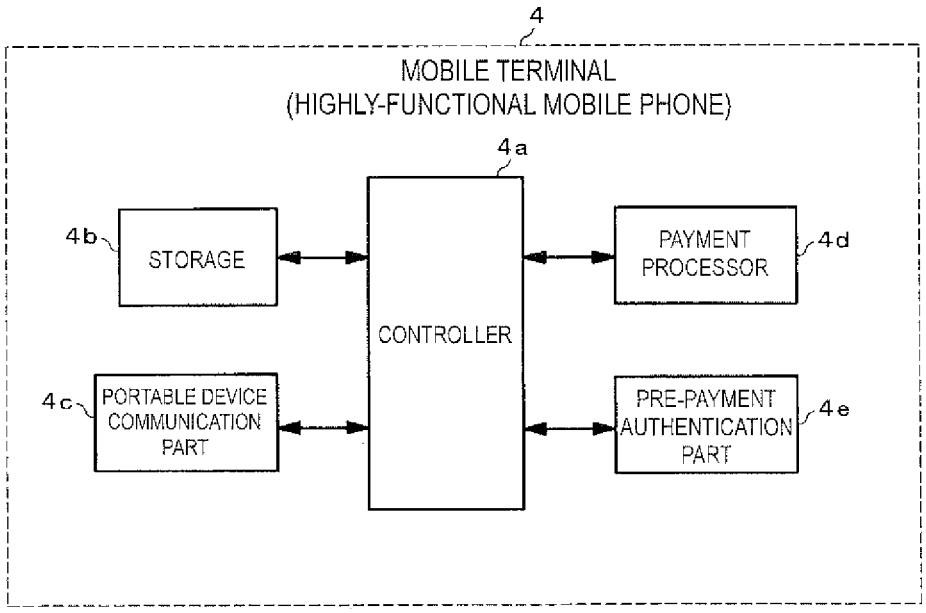
FIG. 5 is a view illustrating a configuration of a mobile terminal in FIG. 1.

The mobile terminal 4 includes a highly-functional mobile phone carried by the user. As illustrated in FIG. 5, the mobile terminal 4 includes a controller 4*a*, a storage 4*b*, a portable device communication part 4*c*, a payment processor 4*d*, and a pre-payment authentication part 4*e*. The controller 4*a* includes a microcomputer, and controls each part of the mobile terminal 4. The storage 4*b* includes a memory. The portable device communication part 4*c* includes a short-distance wireless communication antenna, a transmitting circuit, and a receiving circuit. The portable device communication part 4*c* transmits and receives the signal and the information to and from the portable device 1.

The payment processor 4*d* and the pre-payment authentication part 4*e* include a microcomputer. The payment processor 4*d* performs fuel supply payment processing. The payment processor 4*d* is an example of the "payment part" according to one or more embodiments of the present invention. The pre-payment authentication part 4*e* authenticates the portable device 1 before the payment processor 4*d* performs the payment processing. The pre-payment authentication part 4*e* is an example of the "pre-payment authentication part" according to one or more embodiments of the present invention.

Pieces of processing performed by the devices 1 to 4 during the fuel supply to the vehicle 10 will be described below with reference to FIGS. 6 and 7A-7C. FIGS. 1 to 5 are also referred to as appropriate.

The user stops the vehicle 10 in a fuel supply block (not illustrated) of the fuel supply facility 30 in order to refuel the vehicle 10 (see FIG. 1). Then the user gets out of the vehicle 10 to stand in front of the facility communicator 3. The human sensor 3*g* (see FIG. 4) of the facility communicator 3 senses the user. Therefore, the controller 3*a* displays a guide screen (not illustrated) on the display screen 3*f* of the operation part 3*d*. When the user performs a predetermined operation on the guide screen, the controller 3*a* determines that the user's operation is detected (Step S1 in FIG. 6).

Figure 6:
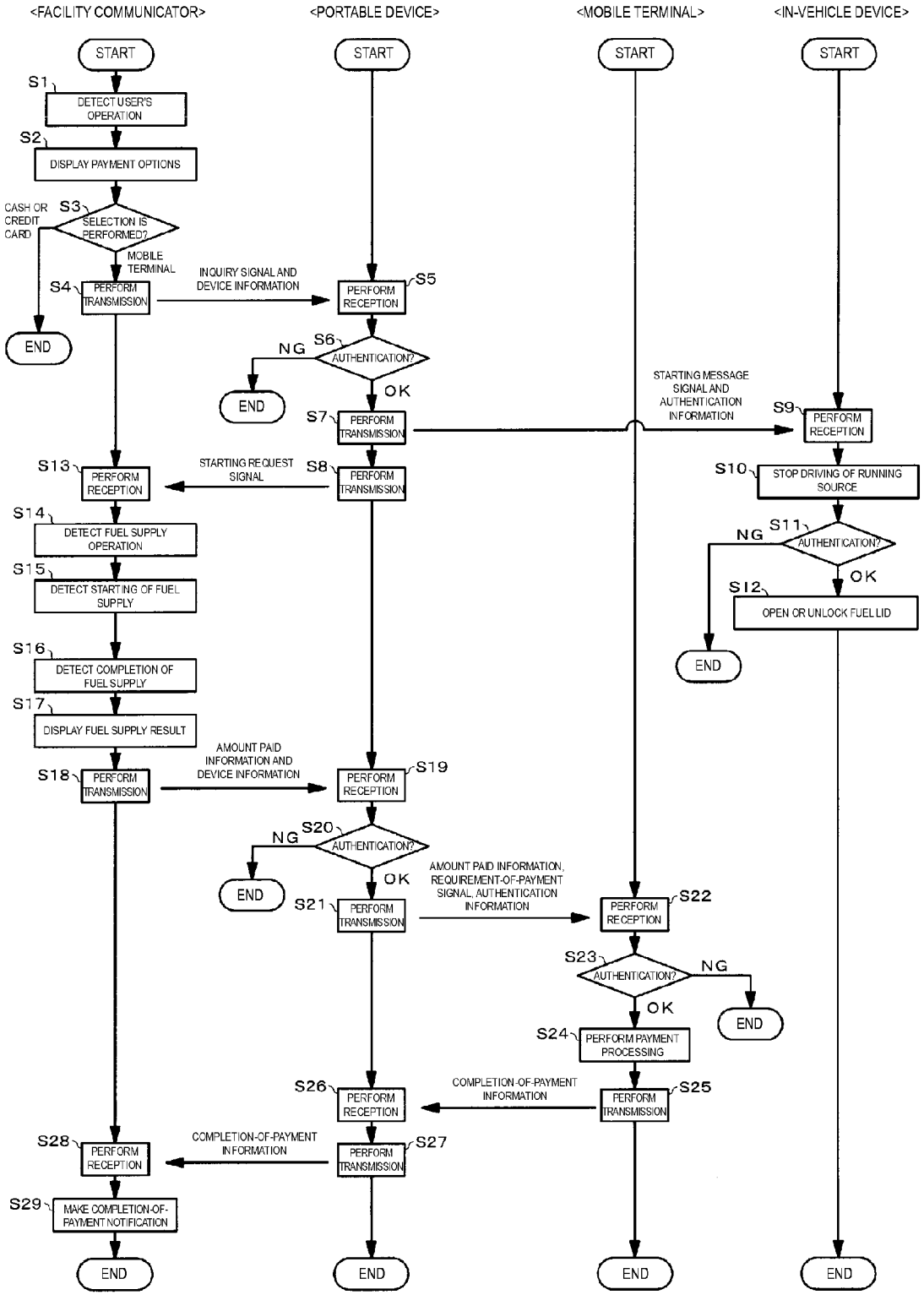
FIG. 6 is a flowchart of the control system in FIG. 1 during fuel supply.
Figure 7A:
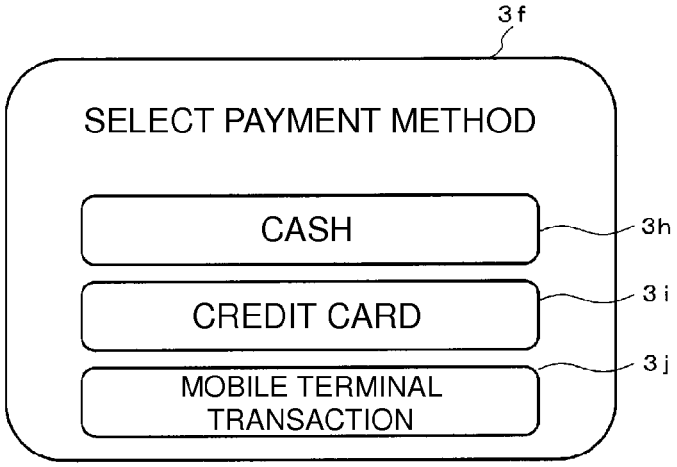
FIG. 7A-7C are views illustrating a display example of a display screen of the facility communicator in FIG. 1.

Then, as illustrated in FIG. 7A, the controller 3*a* displays options 3*h*, 3*i*, and 3*j* of a fuel supply payment method on the display screen 3*f* (Step S2 in FIG. 6). In one or more embodiments of the present invention, three keys, namely, "cash" 3*h*, "credit card" 3*i*, and "mobile terminal transaction" 3*j* are displayed as the options of the payment method. At this point, in the case that the user touches the "cash" 3*h* or the "credit card" 3*i*, the controller 3*a* determines that the user selects the payment in cash or by credit card (cash or credit card in Step S3 in FIG. 6), and the subsequent processing is ended.

On the other hand, in the case that the user touches the "mobile terminal transaction" 3*j* in the options 3*h*, 3*i*, and 3*j* in FIG. 7A, the controller 3*a* determines that the user selects the payment by the mobile terminal 4 (mobile terminal in Step S3 in FIG. 6). In this case, the controller 3*a* transmits a fuel supply inquiry signal and device information authenticating the facility communicator 3 to the portable device 1 carried by the user using the portable device communication part 3*c* (see FIG. 4) (Step S4 in FIG. 6).

When the controller 1*a* (see FIG. 2) of the portable device 1 receives the inquiry signal and the device information from the facility communicator 3 through the facility communication part 1*d* (Step S5 in FIG. 6), the communicator authentication part 1*f* (see FIG. 2) authenticates the facility communicator 3 based on the device information (Step S6 in FIG. 6).

The portable device 1 may authenticate the facility communicator 3 based only on the device information received from the facility communicator 3. Alternatively, the identification information on the facility communicator 3 is previously stored in the storage 1*b* (see FIG. 2) of the portable device 1, and the facility communicator 3 may be authenticated based on a checking result of the identification information and the received device information. The same holds true for Step S20 in FIG. 6.

When the authentication result of the facility communicator 3 is NG (abnormal) in the communicator authentication part if (NG in Step S6 in FIG. 6), the subsequent processing is ended.

On the other hand, when the authentication result of the facility communicator 3 is OK (normal) in the communicator authentication part if (OK in Step S6 in FIG. 6), the controller 1*a* transmits a fuel supply starting message signal and authentication information on the portable device 1 to the in-vehicle device 2 mounted on the vehicle 10 using the in-vehicle-device communication part 1*c* (see FIG. 2) (Step S7 in FIG. 6). The controller 1*a* also transmits a fuel supply starting request signal to the facility communicator 3 using the facility communication part 1*d* (Step S8 in FIG. 6).

When the main controller 2*a* (see FIG. 3) of the in-vehicle device 2 receives the starting request signal and the authentication information from the portable device 1 through the portable device communication part 2*d* (Step S9 in FIG. 6), the main controller 2*a* transmits a command to the running source controller 2*f* (see FIG. 3) to stop the driving of the running source 12 of the vehicle 10 (Step S10 in FIG. 6). Based on the received authentication information, the main controller 2*a* authenticates the portable device 1 using the portable device authentication part 2*c* (see FIG. 3) (Step S11 in FIG. 6).

At this point, the main controller 2*a* checks the received authentication information on the portable device 1 against the registered information on the portable device 1, which is stored in the storage 2*b* (see FIG. 3), and the main controller 2*a* authenticates the portable device 1 based on the checking result. When the authentication result of the portable device 1 is NG (abnormal) (NG in Step S11 in FIG. 6), the subsequent processing is ended.

On the other hand, when the authentication result of the portable device 1 is OK (normal) in the portable device authentication part 2*c* (OK in Step S11 in FIG. 6), the main controller 2*a* transmits the command to the fuel lid controller 2*e* (see FIG. 3) to open or unlock the fuel lid 11 of the vehicle 10 (Step S12 in FIG. 6). Therefore, the user can supply the fuel to the vehicle 10 using the fuel supply device 31 (see FIG. 4) installed in the fuel supply facility 30.

The controller 3*a* of the facility communicator 3 receives the starting request signal from the portable device 1 through the portable device communication part 3*c* (Step S13 in FIG. 6). For example, when the user holds a supply lever of the fuel supply device 31 or connects a charging socket to the vehicle 10, the state detector 3*e* of the facility communicator 3 detects the user's fuel supply operation (Step S14 in FIG. 6). When the user starts the fuel supply to the vehicle 10 using the fuel supply device 31, the state detector 3*e* detects a starting state of the fuel supply device 31 (Step S15 in FIG. 6).

When the fuel supply to the vehicle 10 is completed using the fuel supply device 31, the user returns each part of the fuel supply device 31 to an original state, and closes or locks the fuel lid 11 of the vehicle 10.

Figure 7B:
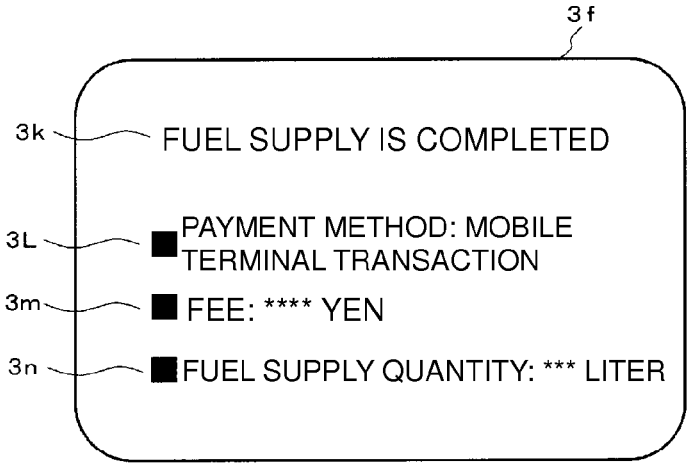

When the fuel supply to the vehicle 10 with the fuel supply device 31 is stopped to return each part of the fuel supply device 31 to the original state, the state detector 3*e* (see FIG. 4) of the facility communicator 3 detects that the fuel supply is completed (Step S16 in FIG. 6). As illustrated in FIG. 7B, the controller 3*a* displays a fuel supply result on the display screen 3*f* (Step S17 in FIG. 6). In one or more embodiments of the present invention, a notification 3*k* indicating the completion of the fuel supply, a payment method selection result 3L, amount paid of fuel supply 3*m*, and a fuel supply quantity 3*n* are displayed as the fuel supply result.

The controller 3*a* of the facility communicator 3 transmits amount paid information and the device information on the facility communicator 3 to the portable device 1 using the portable device communication part 3*c* (Step S18 in FIG. 6). When the controller 1*a* of the portable device 1 receives the amount paid information and the device information from the facility communicator 3 through the facility communication part 1*d* (Step S19 in FIG. 6), the communicator authentication part 1*f* (see FIG. 2) authenticates the facility communicator 3 based on the device information (Step S20 in FIG. 6).

Because the device information on the facility communicator 3 is transmitted from the facility communicator 3 in Step S4 in FIG. 6 and received by the portable device 1 in Step S5, the transmission of the device information may be eliminated in Step S18. In this case, the device information on the facility communicator 3, which is received in Step S5, may be stored in the storage 1*b* of the portable device 1. When receiving the amount paid information in Step S19 in FIG. 6, the controller 1*a* may read the device information on the facility communicator 3 from the storage 1*b* in Step S20, and authenticate the facility communicator 3 using the communicator authentication part 1*f* based on the device information.

When the authentication result of the facility communicator 3 is NG (abnormal) in the communicator authentication part if (NG in Step S20 in FIG. 6), the subsequent processing is ended.

On the other hand, when the authentication result of the facility communicator 3 is OK (normal) in the communicator authentication part if (OK in Step S20 in FIG. 6), the controller 1*a* transmits the amount paid information, requirement-of-payment signal, and the authentication information on the portable device 1 to the mobile terminal 4 carried by the user using the terminal communication part 1*e* (Step S21 in FIG. 6).

When the controller 4*a* (see FIG. 5) of the mobile terminal 4 receives the amount paid information, the requirement-of-payment signal, and the authentication information from the portable device 1 through the portable device communication part 4*c* (Step S22 in FIG. 6), the pre-payment authentication part 4*e* (see FIG. 5) authenticates the portable device 1 based on the authentication information (Step S23 in FIG. 6).

The mobile terminal 4 may authenticate the portable device 1 based only on the authentication information received from the portable device 1. Alternatively, the identification information on the portable device 1 is previously stored in the storage 4*b* (see FIG. 5) of the mobile terminal 4, and the portable device 1 may be authenticated based on the checking result of the identification information and the received authentication information.

When the authentication result of the portable device 1 is NG (abnormal) in the pre-payment authentication part 4*e* (NG in Step S23 in FIG. 6), the subsequent processing is ended.

On the other hand, when the authentication result of the portable device 1 is OK (normal) in the pre-payment authentication part 4*e* (OK in Step S23 in FIG. 6), the payment processor 4*d* (see FIG. 5) performs predetermined payment processing based on the amount paid information (Step S24 in FIG. 6). Specifically, for example, the transaction of the fuel supply is performed by an electronic money function of the mobile terminal 4. When the payment processing is completed, the controller 4*a* transmits completion-of-payment information to the portable device 1 using the portable device communication part 4*c* (Step S25 in FIG. 6).

When the controller 1*a* (see FIG. 2) of the portable device 1 receives the completion-of-payment information from the mobile terminal 4 through the terminal communication part 1*e* (Step S26 in FIG. 6), the facility communication part 1*d* (see FIG. 2) transmits the completion-of-payment information to the facility communicator 3 (Step S27 in FIG. 6). When receiving the completion-of-payment information from the portable device 1 through the portable device communication part 3*c* (Step S28 in FIG. 6), the controller 3*a* (see FIG. 4) of the facility communicator 3 notifies the user that the payment of the fuel supply is completed (Step S29 in FIG. 6).

Figure 7C:
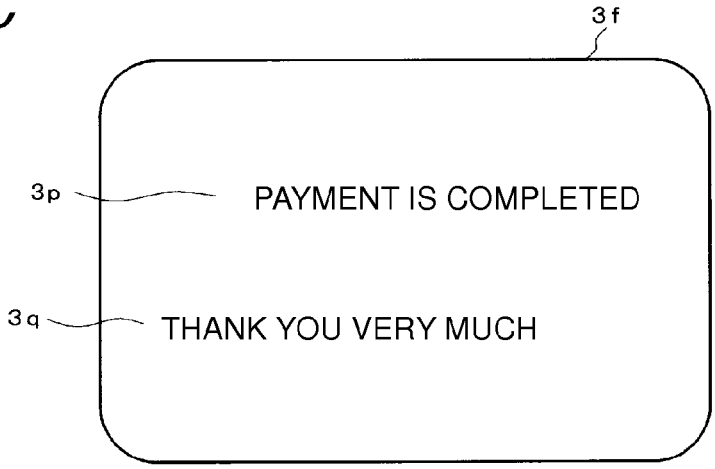

Specifically, as illustrated in FIG. 7C, a notification 3*p* indicating the completion of payment is displayed on the display screen 3*f* of the facility communicator 3. A notification 3*q* indicating acknowledgment is also displayed on the display screen 3*f*. Alternatively, the user may be notified of the completion of payment and the acknowledgment audio notification through sound.

According to one or more embodiments of the present invention, the communication among the portable device 1, the in-vehicle device 2, and the facility communicator 3, and the opening or unlocking of the fuel lid 11 of the vehicle 10 are automatically performed, so that the convenience can be improved during the fuel supply to the vehicle 10.

When the fuel is supplied to the vehicle 10 using the fuel supply facility 30, based on the user's operation in the facility communicator 3, the portable device 1 becomes a gate between the facility communicator 3 and the in-vehicle device 2 and the wireless communication is conducted among the devices 1 to 3. Therefore, the facility communicator 3 identifies the vehicle 10 of a fuel supply destination without retaining the identification information on the user or the vehicle 10, and the fuel lid 11 of the vehicle 10 is opened or unlocked. That is, the fuel lid 11 is not opened unless the user possesses the portable device 1, so that security can be improved during the fuel supply to the vehicle 10.

It is not necessary to separately provide a server to retain the pieces of information on the devices 1 to 4. Therefore, the configuration of the fuel supply system 100 can be simplified.

In one or more embodiments of the present invention, when the in-vehicle device 2 receives the starting message signal from the portable device 1, the running source controller 2*f* stops the driving of the running source 12 of the vehicle 10. Therefore, the fuel can safely be supplied to the vehicle 10 while the driving of the running source 12 is securely stopped.

In one or more embodiments of the present invention, after the fuel supply to the vehicle 10 is completed, the facility communicator 3 transmits the amount paid information indicating the price of the fuel supply to the mobile terminal 4 through the portable device 1. The payment processing for the fuel supply to the vehicle 10 is performed with the mobile terminal 4 that is easily handled by the user. At this point, it is not necessary for the user to bring out the portable device 1 or the mobile terminal 4 or to perform some sort of operation. Therefore, the convenience can further be improved.

In one or more embodiments of the present invention, when the payment processing is completed by the mobile terminal 4, the facility communicator 3 notifies the user that the payment of the fuel supply is completed. Therefore, the user can recognize the completion of payment. A notification content is stored in the mobile terminal 4, which allows the user to check the amount paid later. Therefore, the convenience can further be improved.

In one or more embodiments of the present invention, when the user selects the "mobile terminal transaction" 3*j* on the display screen 3*f* in FIG. 7A, the facility communicator 3 transmits the inquiry signal to the portable device 1. In the case that the payment processing for the fuel supply is performed by the mobile terminal 4, the portable device 1 becomes the gate between the facility communicator 3 and the in-vehicle device 2 or the mobile terminal 4 to conduct wireless communication among the devices 1 to 4, so that the security can further be improved.

In one or more embodiments of the present invention, the portable device 1 authenticates the facility communicator 3 when receiving the inquiry signal and the device information from the facility communicator 3, and the portable device 1 transmits the fuel supply starting request signal to the facility communicator 3 when completing the authentication. The subsequent pieces of fuel supply processing are performed by the facility communicator 3 in which the authentication is completed by the portable device 1, so that the security can further be improved.

In one or more embodiments of the present invention, the portable device 1 authenticates the facility communicator 3 when receiving the amount paid information and the device information from the facility communicator 3, and the portable device 1 transmits the amount paid information to the mobile terminal 4 when completing the authentication. The payment processing is performed by the mobile terminal 4 based on the amount paid information transmitted from the facility communicator 3 in which the authentication is completed by the portable device 1, so that the security can further be improved.

In one or more embodiments of the present invention, the mobile terminal 4 authenticates the portable device 1 when receiving the amount paid information, the requirement-of-payment signal, and the authentication information from the portable device 1, and the mobile terminal 4 performs the payment processing based on the amount paid information when completing the authentication. The payment processing for the fuel supply is performed based on the amount paid information transmitted from the portable device 1 in which the authentication is completed by the mobile terminal 4, so that the security can further be improved.

In addition to the above embodiments, various other embodiments are within the scope of the present invention. In one or more of the above embodiments, by way of example, in the case that the user selects the "mobile terminal transaction" 3*j* on the display screen 3*f* in FIG. 7A, the facility communicator 3 transmits the inquiry signal to the portable device 2 (mobile terminal in Step S3 in FIG. 6). Alternatively, for example, as illustrated in FIG. 8, when detecting the user's operation (Step S1 in FIG. 8), the facility communicator 3 may transmit the inquiry signal and the device information to the portable device 1 (Step S1*a* in FIG. 8).

Figure 8:
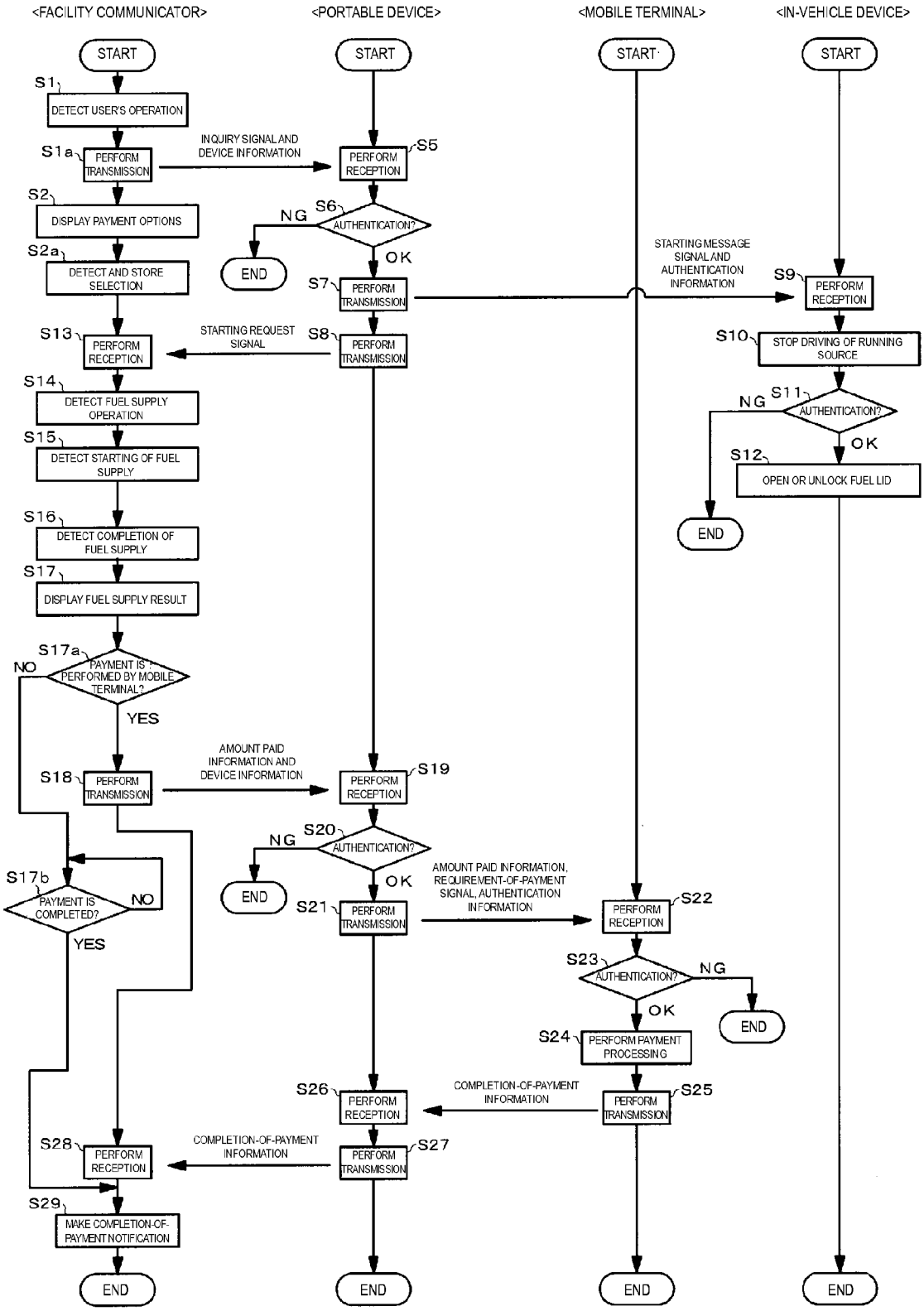
FIG. 8 is a flowchart according to one or more embodiments of the present invention.

In this case, after the controller 3*a* (see FIG. 4) of the facility communicator 3 displays the payment method options on the display screen 3*f* (Step S2 in FIG. 8), the controller 3*a* stores the payment method in the storage 3*b* when detecting the payment method selected by the user (Step S2*a* in FIG. 8).

After the controller 3*a* displays the fuel supply result on the display screen 3*f* in Step S17, when the payment by the mobile terminal 4 is already selected (YES in Step S17*a* in FIG. 8), the controller 3*a* transmits the amount paid information and the device information on the facility communicator 3 to the portable device 1 (Step S18 in FIG. 8). On the other hand, when the payment in cash or by credit card is already selected (NO in Step S17*a* in FIG. 8), the controller 3*a* waits for the payment operation performed by the user. When the user pays the fuel supply in cash or by credit card, the controller 3*a* determines that the payment is completed (YES in Step S17*b* in FIG. 8), and notifies the user of the completion of payment (Step S29 in FIG. 8).

In FIGS. 6 and 8, the user's operation is detected in Step S1. Alternatively, existence of the user may be detected. In this case, the human sensor 3*g* senses whether the user stands in front of the facility communicator 3.

In one or more embodiments of the present invention, by way of example, the portable device 1 authenticates the facility communicator 3, and the mobile terminal 4 authenticates the portable device 1. Alternatively, the authentication of the facility communicator 3 and the authentication of the portable device 1 may be eliminated.

In the above description, by way of example, one or more embodiments of the present invention is applied to the portable device 1 having the configuration in FIG. 2. Alternatively, one or more embodiments of the present invention can be applied to other portable devices.

In the above description, by way of example, one or more embodiments of the present invention is applied to the control system 100 having the configurations in FIGS. 1 to 5. Alternatively, one or more embodiments of the present invention can be applied to a control system having another configuration.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A control system during fuel supply to a vehicle, comprising:

a portable device configured to be carried by a user; and an in-vehicle device that is mounted on the vehicle to conduct wireless communication with the portable device, wherein the portable device is configured to conduct wireless communication with a facility communicator that is installed in a fuel supply facility, wherein the in-vehicle device includes a portable device authentication part that authenticates the portable device and a fuel supply lid controller that opens or unlocks a fuel supply lid of the vehicle, wherein the portable device receives a fuel supply inquiry signal transmitted by the facility communicator when the facility communicator detects an operation performed by the user or existence of the user, wherein the portable device transmits a fuel supply starting message signal and authentication information on the portable device to the in-vehicle device when receiving the inquiry signal from the facility communicator, wherein the in-vehicle device authenticates the portable device using the portable device authentication part based on the authentication information when receiving the starting message signal and the authentication information from the portable device, wherein the in-vehicle device opens or unlocks the fuel supply lid using the fuel supply lid controller when the authentication result is normal, wherein the control system further comprises a mobile terminal configured to be carried by the user to conduct short-distance wireless communication with the portable device, wherein the mobile terminal includes a payment part that performs payment processing for fuel supply, wherein the portable device receives amount paid information indicating a price of the fuel supply transmitted by the facility communicator transmits after the fuel supply to the vehicle is completed, wherein the portable device transmits the amount paid information and requirement-of-payment signal to the mobile terminal when receiving the amount paid information from the facility communicator, and wherein the mobile terminal performs the payment processing using the payment part based on the amount paid information when receiving the amount paid information and the requirement-of-payment signal from the portable device.

2. The control system according to claim 1, wherein the in-vehicle device further includes a running source controller that controls driving of a running source of the vehicle, and wherein the running source controller stops the driving of the running source when the starting message signal is received from the portable device.

3. The control system according to claim 1, wherein the mobile terminal transmits completion-of-payment information to the portable device when the payment part completes the payment processing, wherein the portable device transmits the completion-of-payment information to the facility communicator when receiving the completion-of-payment information from the mobile terminal, wherein the control system receives notification from the facility communicator that liquidation of the fuel supply is completed when receiving the completion-of-payment information from the portable device, and wherein the control system notifies the user that the fuel supply is completed.

4. The control system according to claim 1, wherein the portable device receives inquiry signal and device information authenticating the facility communicator transmitted by the facility communicator, wherein the portable device includes a communicator authentication part that authenticates the facility communicator, wherein the portable device authenticates the facility communicator using the communicator authentication part based on the device information when receiving the device information from the facility communicator, and wherein the portable device transmits a fuel supply starting request signal to the facility communicator when the authentication result is normal.

5. The control system according to claim 4, wherein the portable device authenticates the facility communicator using the communicator authentication part based on the device information when receiving the amount paid information and the device information from the facility communicator, and wherein the portable device transmits the amount paid information and the requirement-of-payment signal to the mobile terminal when the authentication result is normal.

6. The control system according to claim 1, wherein the portable device transmits the amount paid information, the requirement-of-payment signal, and authentication information on the portable device to the mobile terminal, wherein the mobile terminal includes a pre-payment authentication part that authenticates the portable device before the payment processing, wherein the mobile terminal authenticates the portable device using the pre-payment authentication part based on the authentication information when receiving the amount paid information, the requirement-of-payment signal, and the authentication information from the portable device, and wherein the mobile terminal performs the payment processing using the payment part based on the amount paid information when the authentication result is normal.

7. A portable device configured to be carried by a user, wherein the portable device conducts wireless communication with an in-vehicle device mounted on a vehicle, wherein the portable device is authenticated by the in-vehicle device, wherein the portable device transmits a fuel supply starting message signal and authentication information on the portable device to the in-vehicle device to cause the in-vehicle device to authenticate the portable device when conducting wireless communication with a facility communicator mounted on a fuel supply facility to receive a fuel supply inquiry signal from the facility communicator, and wherein the portable device causes the in-vehicle device to open or unlock a fuel supply lid of the vehicle when the authentication result is normal, wherein the portable device conducts short-distance wireless communication with a mobile terminal carried by a user when receiving amount paid information indicating a price of fuel supply from the facility communicator after the fuel supply to the vehicle is completed, and wherein the portable device causes the mobile terminal to perform payment processing for the fuel supply based on the amount paid information by transmitting the amount paid information and requirement-of-payment signal to the mobile terminal.

8. The portable device according to claim 7, comprising:

a communicator authentication part that authenticates the facility communicator, wherein, when the portable device receives the inquiry signal and device information authenticating the facility communicator from the facility communicator, the communicator authentication part authenticates the facility communicator based on the device information, and wherein a fuel supply starting request signal is transmitted to the facility communicator when the authentication result is normal.

9. The portable device according to claim 8, wherein, when the portable device receives the amount paid information and the device information from the facility communicator, the communicator authentication part authenticates the facility communicator based on the device information, and wherein the amount paid information and the requirement-of-payment signal are transmitted to the mobile terminal when the authentication result is normal.

10. The portable device according to claim 7, wherein the mobile terminal is caused to authenticate the portable device based on the authentication information by transmitting the amount paid information, the requirement-of-payment signal, and authentication information on the portable device to the mobile terminal, and the mobile terminal is caused to perform payment processing based on the amount paid information when the authentication result is normal.

11. The portable device according to claim 10, wherein, when completion-of-payment information indicating completion of the payment processing based on the amount paid information is received from the mobile terminal, the facility communicator is caused to notify the user that payment of the fuel supply is completed by transmitting the completion-of-payment information to the facility communicator.

12. A control system during fuel supply to a vehicle, comprising:

a portable device configured to be carried by a user; and an in-vehicle device that is mounted on the vehicle to conduct wireless communication with the portable device; and a facility communicator that is installed in a fuel supply facility to conduct wireless communication with the portable device, wherein the in-vehicle device includes a portable device authentication part that authenticates the portable device and a fuel supply lid controller that opens or unlocks a fuel supply lid of the vehicle, the facility communicator transmits a fuel supply inquiry signal to the portable device when detecting an operation performed by the user or existence of the user, wherein the portable device transmits a fuel supply starting message signal and authentication information on the portable device to the in-vehicle device when receiving the inquiry signal from the facility communicator, wherein the in-vehicle device authenticates the portable device using the portable device authentication part based on the authentication information when receiving the starting message signal and the authentication information from the portable device, wherein the in-vehicle device opens or unlocks the fuel supply lid using the fuel supply lid controller when the authentication result is normal, the control system further comprising a mobile terminal configured to be carried by the user to conduct short-distance wireless communication with the portable device, wherein the mobile terminal includes a payment part that performs payment processing for fuel supply, wherein the facility communicator transmits amount paid information indicating a price of the fuel supply to the portable device after the fuel supply to the vehicle is completed, wherein the portable device transmits the amount paid information and requirement-of-payment signal to the mobile terminal when receiving the amount paid information from the facility communicator, and wherein the mobile terminal performs the payment processing using the payment part based on the amount paid information when receiving the amount paid information and the requirement-of-payment signal from the portable device.

13. The control system according to claim 12, wherein the facility communicator includes a display screen, wherein the facility communicator displays options of a payment method on the display screen when detecting the operation performed by the user or the existence of the user, and wherein the facility communicator transmits the inquiry signal to the portable device when the user selects the payment by the mobile terminal in the options.

14. The control system according to claim 12, wherein the in-vehicle device further includes a running source controller that controls driving of a running source of the vehicle, and wherein the running source controller stops the driving of the running source when the starting message signal is received from the portable device.

15. The control system according to claim 12, wherein the mobile terminal transmits completion-of-payment information to the portable device when the payment part completes the payment processing, wherein the portable device transmits the completion-of-payment information to the facility communicator when receiving the completion-of-payment information from the mobile terminal, wherein the control system receives notification from the facility communicator that payment of the fuel supply is completed when receiving the completion-of-payment information from the portable device, and wherein the control system notifies the user that the fuel supply is completed.

16. The control system according to claim 12, wherein the facility communicator transmits inquiry signal and device information authenticating the facility communicator to the portable device, and wherein the portable device includes a communicator authentication part that authenticates the facility communicator, wherein the portable device authenticates the facility communicator using the communicator authentication part based on the device information when receiving the device information from the facility communicator, and wherein the portable device transmits a fuel supply starting request signal to the facility communicator when the authentication result is normal.

17. The control system according to claim 16, wherein the portable device authenticates the facility communicator using the communicator authentication part based on the device information when receiving the amount paid information and the device information from the facility communicator, and wherein the portable device transmits the amount paid information and the requirement-of-payment signal to the mobile terminal when the authentication result is normal.

* * * * *